United States Patent [19]

Caine

[11] Patent Number: 4,699,538

[45] Date of Patent: Oct. 13, 1987

[54] FILE SYSTEM AND METHOD OF ORGANIZING DOCUMENTS THEREIN

[76] Inventor: Robert S. Caine, 1 Crabtree La., Roslyn, N.Y. 11576

[21] Appl. No.: 827,899

[22] Filed: Feb. 7, 1986

[51] Int. Cl.[4] ..... B42F 13/00; B42F 21/00; B42D 3/04; A44B 19/02

[52] U.S. Cl. ..... 402/79; 281/17; 283/41; 24/306

[58] Field of Search ..... 402/2, 4, 7, 15, 18, 402/21, 22, 46, 54, 58, 66, 75, 79, 80 R, 502, 75.79, 80 R; 281/24, 25 R, 17, 28, 31, 38, 17; 24/306; 283/41, 306

[56] References Cited

U.S. PATENT DOCUMENTS

| | | | |
|---|---|---|---|
| 1,958,058 | 5/1934 | McCleary | 281/17 |
| 3,176,364 | 4/1965 | Dritz | 24/306 |
| 3,353,844 | 11/1967 | Staats | 281/17 |
| 3,684,340 | 8/1972 | Kirkorian | 402/4 |
| 3,752,503 | 8/1973 | Holes | 281/17 |
| 3,805,426 | 4/1974 | Cunningham | 283/41 |
| 4,442,306 | 6/1985 | Cooper | 402/79 |
| 4,445,710 | 5/1984 | Borec | 402/502 |

FOREIGN PATENT DOCUMENTS

| | | | |
|---|---|---|---|
| 1187966 | 5/1967 | United Kingdom | 281/17 |

*Primary Examiner*—E. R. Kazenske
*Assistant Examiner*—Paul M. Heyrana, Sr.
*Attorney, Agent, or Firm*—Jerome Bauer

[57] ABSTRACT

The papers in an office file folder are organized into subfiles by dividing the documents including papers and/or other things into predetermined sets. Each set is then secured to a header plate which is removably secured to an associated attachment plate. The attachment plate is itself secured to the file folder cover. The header plate is secured to the attachment by cooperable engaging and separable fastening means.

3 Claims, 9 Drawing Figures

FILE SYSTEM AND METHOD OF ORGANIZING DOCUMENTS THEREIN

BACKGROUND OF THE INVENTION

The present invention relates to a novel subfile and method for organizing into subfiles documents including papers and/or other things in an office file folder or the like, for separate removal and replacement without removal of any other document including a paper or subfile, and in particular to the system and devices necessary to accomplish the same.

The maintenance of files in most offices presents a great many problems. In general the files are normally arranged with individual pieces of paper or groups of papers stapled together and then set one upon the other chronologically. Each individual paper, set or group of papers is punched with holes and held to the file folder generally by a prong type foldable fastener such as an "ACCO" fastener, although other clips or fastening means are sometimes also employed. Unfortunately, when one or more earlier filed papers at the bottom or middle of the file must be referred to or separated from the file, it is necessary and difficult to remove the papers above it before getting to the exact group of papers needed, let alone the exact paper that is desired to be removed.

The way this is presently done is that the removable or openable fastener holding all the papers is opened, the groups of papers or paper above the desired one are removed from the prongs of the fastener, then the group of desired papers are removed from the prongs of the fastener, and finally, the undesired papers previously removed are now returned back onto the prongs of the fastener. Sometime later when it is desired to return the select papers to the file, the process is reversed and repeated with the added disadvantage that in addition to manipulating the papers in the file, one also has to manipulate the group of papers previously removed.

It is an object of the present invention to provide a method and system for organizing files into groups of subfiles by which voluminous separate files or papers may be divided into manageable sections or groups and in which each section or group can be easily removed from the entire file, temporarily or permanently and then replaced very readily and easily into the file again without having to disturb any of the remaining groups of papers in the overall file.

It is also an object of the present invention to provide a method and system in file organization to permit individual, single page or double page documents, which have been "ACCO'd" into the file and which lie beneath numerous other papers that have been filed chronologically thereafter, to be easily removed from the entire file, temporarily or permanently, and then replaced very readily and easily in the same chronological place from which it was taken without disturbing any of the remaining papers in the overall file.

An attempt at organizing a file folder is disclosed in U.S. Pat. No. 4,403,883 in which groups of papers are separately bound by prong fasteners onto a card backing and the several groups then stacked and bound together by another prong fastener into the file folder. In order to remove any group of papers and/or other documents and in particular a single paper from any of the groups, it was necessary to unbind an entire group from its backing, thus leaving the backing bound into the file folder and the individual papers in each group loosely arranged and removed from the folder.

This arrangement obviously does not permit the temporary or permanent removal of the files from the file folder, either as separate papers or in groups in a simple or an expeditious manner. The arrangement disclosed in this patent seems to present a greater problem than that found in the conventional prior art file folders in that in order to remove a single paper, an entire set or group of papers have to be removed and loosely maintained exterior of the file. In addition, this arrangement makes the file folders rather cumbersome and heavy in that the card backing adds to the overall size, weight, and bulk of the file without providing any real advantage.

It is another object of the present invention to provide a simple low-cost system for organizing file papers and for separating such papers into defined, pre-determined sets so that a given one or set of papers or documents can be removed without having to remove any of the papers or documents superposed thereabove.

The foregoing objects, together with other objects will be apparent from the disclosure of the present invention given hereafter.

SUMMARY OF THE INVENTION

In accordance with the present invention, the papers or documents in an office file folder are organized into subfiles by dividing the papers into predetermined sets, securing each set to a header plate which is removably secured to an associated attachment plate, and which itself is secured to the file folder cover. The essence of the present invention lies in the provision of an associated and cooperative pair of plates, one of them, i.e., the attachment plate being more or less permanently attached to the file; the second, i.e., the header plate, being removably securable to the attachment plate.

In using the present invention, individual papers and/or a group of papers such as letters, which are "ACCO'd" into a file and with the most recent-dated letter being placed at the top of the pile, would each be secured to its own header plate which itself would be secured to its own associated attachment plate, which itself would be secured to the file folder cover.

In general, the means by which the papers are secured to the header or by which the attachment plate is secured to the file folder cover, can take any conventional form; it being preferred that such fastening means, as the ACCO-type prong fastener, be employed. However, the means by which the header plate is secured to the attachment plate comprises cooperable contact engaging and easily separable fastening means, that is means which can interengage with each other merely on application of a slight pressure causing the contact of one member against the other. Such means as the VELCRO fastener, or the more current ZIPLOC fastener are preferable for this arrangement.

In the preferred form, the header plate and attachment plates are interchangeable and are formed of elongated pliable or semi-rigid members in the shape of strips. Preferably they may be of plastic with each having the contact fastening means disposed on one surface along a longitudinal portion along an edge thereof. The means for attaching the strip to the file folder, or the paper or document to the strip can be arranged along the remaining section or portion of the strip. Preferably, the latter means comprise merely holes through which a releasable ACCO prong type fastener or other releasable clips may be inserted.

The header and attachment plates or strips lend themselves to various design arrangements and to various modifications which would adapt them to particular office functions, for example, they may be provided with indicia tabs, or slots in which the tabs may be placed, or they may be color coded or the like to provide a ready indication of the file contents.

Full details of the present invention are set forth in the following description and are shown in the accompanying drawings.

DESCRIPTION OF THE INVENTION

Figure 1:
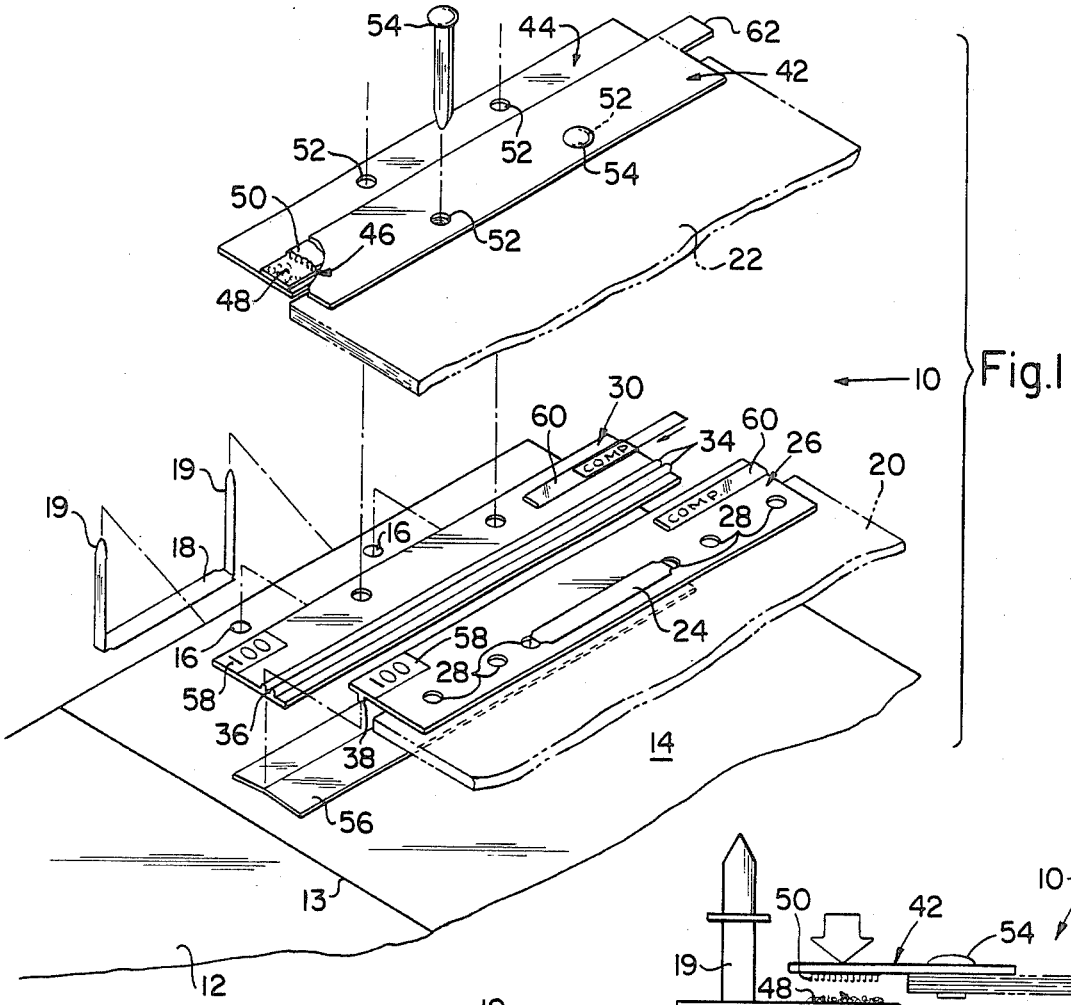
FIG. 1 is an exploded isometric view showing two compatible type of subfile arrangements in displaced relationship.

As seen in the Figures of the drawing, a file, generally depicted by the numeral 10 is arranged in accordance with the present method and employing the system of the present invention. It comprises a standard file folder, having a front cover 12 foldable along a fold line 13 relative to and over a rear cover 14 in at least which a pair of holes 16 are formed along the top edge portion for receiving the base 18 of the conventional prong type fastener such as an ACCO fastener having easily bent, relatively spaced prongs 19.

The material as papers and other documents to be incorporated into the file, either singly or in stapled groups, have been illustrated as divided into a plurality of subfiles, here illustrated for convenience by two sets 20 and 22. The lowermost set 20, presumably consisting of the earlier papers in the file, are attached by a conventional means, here shown for convenience of illustration as a prong fastener 24 to a header plate generally identified 26 which is provided with a plurality of space holes 28. The number and relative spacing of the holes 28 may be arranged to accommodate one or more prong fasteners or other clip means of different kinds.

Associated with the header plate 26 is an attachment plate generally identified 30 formed with a plurality of holes 32, at least two of which match the holes 16 in the cover 14 of the file folder 10, so that the attachment plate 30 may be directly attached to cover 14 by the prongs 19 of the fastener 18. This enables the attachment plate 30 to be more or less permanently secured to the rear cover 14. The number and relative spacing of the holes 32 are provided to match with numerous file covers of different sizes and relative spacings of fastener holes 16.

The header plate 26 and the attachment plate 30 are formed respectively with the opposite mating releasable fastener parts of a contact type interlocking member commonly known as a ZIPLOC, which includes mating easily engaged and disengaged male and female members respectively. The female member is provided with a relatively spaced pair of elongated continuous beads 34 that define an elongated engaging groove 36 therebetween. The male member 38 is formed as a single continuous elongated bead. The beads 34 are bendable and yieldable thereby permitting the walls of the groove 36 to flex and securely hold against the sides of the bead 38 when the same is pressed thereinto. Conversely, the groove flexes to permit their separation when the bead is lifted outward of the groove.

Figure 3:
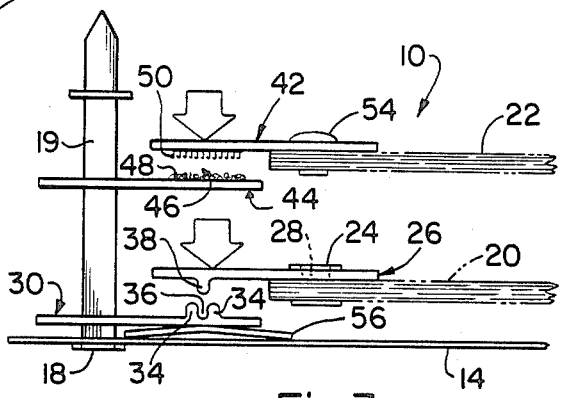
FIG. 3 is a side view of the file of FIG. 1 to ilustrate their manner of assembly and disassembly.
Figure 4:
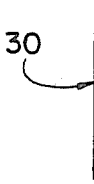
FIG. 4 is an end view of a strip employed either as the header or attachment plate showing the female portion of a ZIPLOC fastener.
Figure 4A:
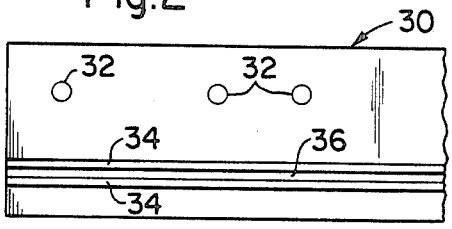
FIG. 4*a* is a partial plan view of the strip of FIG. 4.
Figure 5:
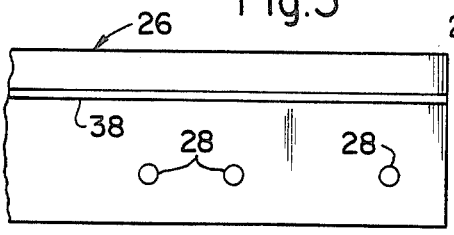
FIG. 5 is a plan view of a cooperating male strip.
Figure 5A:
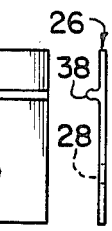
FIG. 5*a* is a partial end view of the strip of FIG. 5.
Figure 6:
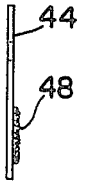
FIG. 6 is an end view of a strip showing the loop or mat portion of a VELCRO fastener.

Interengagement of the cooperating plates 26 and 30 is obtained by progressively inserting and pressing the single bead 38 between the pair of beads 36 of the female member 34 by applying pressure in the direction of the arrow in FIG. 3. The two plates 26 and 30 are quickly separated by lifting the plate 26 away from plate 30 in the direction opposite the arrow to pull the bead 38 out of the groove 36. While the single beaded male portion 38 is shown on the header plate 26 and the female portion 34 is shown on the attachment plate 30, it is quite apparent that the positions may be reversed. Since the header and attachment plates 26 and 30 are otherwise formed identically, their functions are interchangable. Consequently, the header plate 26 can be used as the attachment plate and the attachment plate 30 can be used as the header plate.

Further, for ease of illustration, the group or set of papers or documents 20 is shown as being mounted on the undersurface of the header plate 26 with the prongs of the fastener 24 depending downward through the openings 32. It is quite clear that the papers or documents 20 may be stacked first as well on the upper surface of the header plate 26, and the prong fastener 24 inverted so that its prongs point upwardly and project up through the holes 28 and the papers 20.

Figure 2:
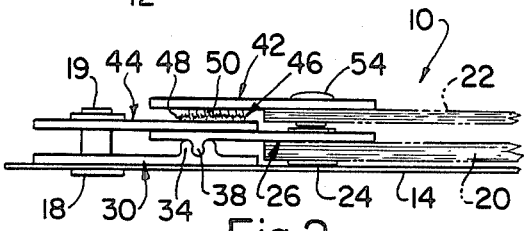
FIG. 2 is a side view of the file of FIG. 1 as assembled.

The illustration of FIGS. 2 and 3 have been used to show that other forms of means may be used to releasably secure the attachment and header plates together. In this connection, the upper set of papers 22 is attached to a header plate 42 and an attachment plate generally identified 44, both of which are similar to the plates 26 and 30 described earlier except that the interlocking or releasable securing means is formed by a VELCRO fastener generally identified 46 comprising two parts. One part has a plurality of plastic loops 48 arranged as a continuous mat and a second part comprises a plurality of hook-like members 50. VELCRO fasteners are quite common, and it is believed that further details of the same are unnecessary in the present disclosure.

In the second embodiment the VELCRO fastener 46 is arranged in a strip along longitudinal edge portions of the header and attachment plates, so that when one is placed on top of the other, they interlock and secure the plates together. The remaining opposite edge portions of the header and attachment plates are provided with holes 52, at least two of which are set apart the standard ACCO fastening distance, so that they would be readily employed with ACCO fasteners as well as with other prong fasteners. Additional holes 52 are shown to illustrate the plates 42 and 44 and may be used with other fastener devices. Again the position of the paper set or group of documents 22 as shown on the undersurface of the header plate 42 is done for illustrative purposes only. FIG. 1 is also illustrative of the use of a spreading arm brass clip 54 that may be used in lieu of prong type fasteners.

As seen in FIGS. 2 and 3, successive layers of paper sets or groups can be arranged on a single file cover and on a single prong fastener base. Depending upon the types of documents contained within a single file folder, the same file folder may contain many pairs of complementary header and attachment plates 24 and 30 or 42 and 44 each using either the ZIPLOC arrangement, the VELCRO arrangement or any other suitable quick connect device. In either case, interengagement of the header plate on the attachment plate is effected merely by lightly pressing downwardly on the header plate in the direction of the arrow so that it interlocks with the attachment plate. Excessive compression is unnecessary, since both ZIPLOC and VELCRO fasteners react quite readily to manual manipulation. While the ZIPLOC and VELCRO members can be easily interconnected using the normal desk top as a firm base for pressing the members together, it may be preferred at times to employ a slightly bent metallic strip member 56 (FIGS. 1 and 3), to provide the rigidity and firmness required and a solid base support beneath the fastening means when another solid or unyielding surface beneath the fastening mean is not readily available. The strip 56 is a separate removable element that does not increase the size or weight of the file.

In actual use, each file 10 may be divided into separate subfiles or sets of documents that may include one or more papers 20, 22, etc., which are first attached to a separate header plate 26 or 42, etc. which is then secured onto the associated attachment plate 30 or 44, etc. Also in actual use, each file may be composed of individual pages which are first attached to a separate header plate 26 or 42, etc., which is then secured onto the associated attachment plate 39 or 44, etc. In either case, the attachment plate is then placed onto the prongs 19 of the fastener base 18 attached to the cover 14 in the file folder 10. In this way the file may be built up and piled chronologically with each separate new and more recently dated group of papers piled one on top of the other. When the user desires to use a specific set of papers or to gain access to a given paper within a single set, all that needs to be done is to detach and remove a single header plate 26, 42, etc. and its attached specific set of papers 20, 22, etc.

This is done by unzipping or unfastening by lifting free whatever fastening means (VELCRO, ZIPLOC, etc.) is utilized to secure together the associated attachment plate and the header plate. The header plate is easily and quickly removed from the attachment plate without disturbing the respective attachment plate or any of the other sets of paper or any other document or sets of documents or groups or papers and their plates. Note the convenience of removing the desired set 20 or 22 with its supporting header 26 or 42 as a whole so that none of the documents of the set are lost or become accidentally separated from each other of the set. When the need for the removed set of documents is completed, the user merely replaces the header with its attached document or set onto the specific attachment plate from whence it was taken and quickly secures the header plate back to the attachment plate as originally.

Preferably, the attachment plate and the header plate are formed of plastic sheet so that they are easily manipulated and have a degree of flexibility. Sets of plates may be made of varying length, material, and elasticity, depending upon their intended use with respect to the document being inserted into the file. If single or double page letters are being placed in the file, the kind of matter out of which they would be made may be different than if a legal document of 20 to 40 pages was to be placed in the file. In the former, the invention contemplates making sets out of the same type of thin sheet plastic as, for example, sheets of the thickness used for domestic food bags. In the latter, the sets would be made of thicker guage plastic, more or less akin to that of oaktag or cardboard. Regardless of the weight of the set, each set would have the contact fastening means (i.e., ZIPLOC or VELCRO, etc.) disposed on one surface along a longitudinal portion along an edge thereof. The means for attaching strip to the file folder, or the document to the strip, can be arranged along the remaining section or portion of the strip. The attachment plate may be made with predetermined holes to permit it to be inserted into the file by means of an ACCO fastener. The header plate could be attached to the document to be placed into the file by varying means, including the stapling of the top of the document to the header plate, as well as the more conventional releasable ACCO-type fastener or other clip.

Sets of header and attachment plates may include lengths of 5 to 8½ inches, or even greater conforming to the width size of legal, letter, and ledger sized paper. The plates may, of course, be less than the width of the paper being secured, but should be long enough in this direction to hold the papers and header plate safely together. On the other hand, the transverse or width dimension (depth) of the attachment plate and header plate need be no more than 1 and 1½ inches, since neither of the strips is used as backing or support for the entire area of the paper but only to be attached to the top of the documents. However, because they are flexible they may be supported therebeneath by rigid member 56 previously described.

Sets of paired plates could be made in a further series, so that the line of joinder of each pair of header and attachment plates in the set would be slightly lower or higher as measured from the topmost edge than the one below or above it in the stack. Thus, no two lines of joinder would lie in the same vertical line but would be staggered one with respect to the other. This precludes the file from becoming unnecessarily bulky. Thus, the first attachment plate might have a line of joinder one-half inch below the top thereof, while the second might have the line of joinder at five-eighths of an inch from the top and so on.

Figure 7:
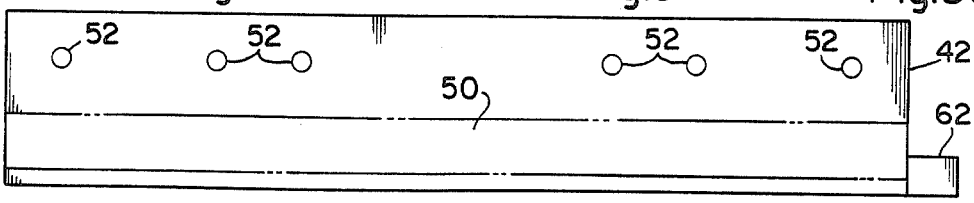
FIG. 7 is a front view of a strip showing the hook portion of the VELCRO fastener.

Spaces in the form of slots 58 and/or windows 60 may be provided on the upper surfaces of both the header and attachment plate 26 and 30 respectively so as to permit the application of legends or other indicia on the members indicating the nature of the papers in the set and the correspondence between the header and the attachment plate, so that they may be easily associated when the file is being reformed. The indicia may be in the form of typed strips, colored strips, or other visual means. For simplicity of the drawings, the slots 58 and windows 60 have not been shown in the header plate and attachment plate 42 and 44 respectively. They may, of course, be employed in such header and attachment plates as desired. The header and the attachment plate may also be provided with projecting tabs 62 extending outwardly from either or both of their ends as is illustrated in FIG. 7.

Further modification may be made by forming either of the header plates 26 or 42 with added strips of material attached along a longitudinal edge to the median line of the plate, so as to form a skirt or tab parallel to that portion of the plate to which the documents are attached and overlying that portion. Thus, additional documents or sets of papers can be attached directly to these skirts or tabs as described or even without removal or disturbance of the original documents or papers attached to the plate.

While emphasis has been placed in the present disclosure on the use of ACCO fasteners to secure the documents to the header plate, it should be readily understood that any type of prong fastener, screw-post fastener or the like may be employed in lieu thereof. It should equally be understood that prong type fasteners may also be used to join the carrier and attachment plates together in lieu of the ZIPLOC and VELCRO means. It is intended that lightweight documents such as single page letters may also be attached to their respective header plates by means of adhesive or staples, as well as any other conventional means. One simple way of assuring attachment to the header plate is to have a glue or cement substance put on the appropriate side of the header plate with a covering of plasticized paper which can readily be removed immediately prior to attaching the document to be inserted in the file. Such adhesives are used commonly on labels and on large business envelopes. For convenience of explanation, the terms "paper" and "document" have been used to indicate the nature of materials that may be included in the file and sets or subfiles of papers and/or documents may consist of singular or plural papers, drawings, documents or the like. Such terms are not to be deemed limiting upon the scope of the invention. Additionally, the terms have been used interchangeably. Hence, the use of any one term is intended to include its usual meaning and also that of the other as well as any other material that is capable of being included in the file within the scope of the inventive teaching.

Various modifications and changes have been described. Others will be obvious to those skilled in the art. Accordingly, the present disclosure should be taken as illustrative only and not limiting of the scope of the invention.

What is claimed is:

1. A system for organizing a plurality of document subfiles in a file folder each of which document subfiles may be removed and replaced without removal of any other documents or subfiles comprising a file folder including a folder member having first releasable fastening means, a subfile organizer for use in said file folder, said subfile organizer comprising two substantially planar normally flat pliable members one of which has means for releasably fastening and unfastening one of said members and the whole of said subfile organizer to said fastening means of said file folder, each said member having releasable cooperable engaging means fastenng said members together and forming said subfile organizer as a single unit such that the fastening and unfastening of one of said members to and from said fastening means of said file folder also fastens and unfastens the other of the members to and from said file folder, said members overlying each other at said releasable cooperable engaging means and one of the members extending in a direction beyond said releasable cooperable engaging means for providing manual engagable means that is manipulated to detach one of the members from the other of the members at said releasable cooperable engaging means while the member releasably engaged with said first releasable fastening means is held thereby to the file folder, and a coextensive portion on the other of the members extending in a direction away from and beyond said releasable cooperable engaging means for mounting one or more documents to form a document subfile that is removable from and reattachable to the member that remains fastened to the document file fastening means.

2. The system according to claim 1, wherein one of the members is provided with tab means extending from at least one end thereof to provide indicia for indicating a feature of the subfile.

3. The system according to claim 1, wherein at least one surface of one of the members is provided with a slot for the receipt of indicia therein for indicating a feature of the subfile.

* * * * *